US009786257B2

(12) United States Patent
Blacker et al.

(10) Patent No.: US 9,786,257 B2
(45) Date of Patent: Oct. 10, 2017

(54) CAPO WITH ATTACHMENT MECHANISM AND FRETTING ACTION IN SEPARATE OFFSET PLANES

(71) Applicant: WILLIAM MARSH RICE UNIVERSITY, Houston, TX (US)

(72) Inventors: Daniel Curtis Blacker, Richmond, TX (US); Matthew Carroll, Mansfield, TX (US); John Vinson Jaggers, Dallas, TX (US)

(73) Assignee: WILLIAM MARSH RICE UNIVERSITY, Houston, TX (US)

( * ) Notice: Subject to any disclaimer, the term of this patent is extended or adjusted under 35 U.S.C. 154(b) by 0 days.

(21) Appl. No.: 14/813,888

(22) Filed: Jul. 30, 2015

(65) Prior Publication Data

US 2017/0032766 A1 Feb. 2, 2017

(51) Int. Cl.
*G10D 3/00* (2006.01)
*G10D 3/04* (2006.01)

(52) U.S. Cl.
CPC ..... *G10D 3/043* (2013.01)

(58) Field of Classification Search
CPC ..... G10D 3/043; G10D 3/046; G10D 3/04
USPC ..... 84/318; D17/20
See application file for complete search history.

(56) References Cited

U.S. PATENT DOCUMENTS

| | | | | |
|---|---|---|---|---|
| 4,503,747 | A * | 3/1985 | Labbe | G10D 3/043 84/318 |
| 6,271,448 | B1 * | 8/2001 | Steinberger | G10D 3/043 84/318 |
| 7,566,824 | B2 | 7/2009 | Small | |
| 7,932,450 | B2 | 4/2011 | Chen | |
| 7,956,263 | B1 | 6/2011 | Volk et al. | |
| 2010/0154616 | A1 | 6/2010 | Campling | |
| 2010/0251873 | A1 | 10/2010 | Paige | |
| 2015/0107437 | A1 * | 4/2015 | Cannon | G10D 3/043 84/318 |

OTHER PUBLICATIONS

International Search Report and Written Opinion in PCT/US2016/43353; dated Dec. 2, 2016.

* cited by examiner

*Primary Examiner* — Jianchun Qin
(74) *Attorney, Agent, or Firm* — Fletcher Yoder, P.C.

(57) ABSTRACT

Embodiments of a capo and fretting component are described. In certain embodiments, the fretting component is threaded onto a crossbar configured to overlie the instrument strings when in use and to pivot with respect to the crossbar so as to contact and press the strings against a fret on the instrument neck. The fretting component is offset with respect to the attachment mechanism of the capo, allowing the attachment mechanism to be offset on the neck of the instrument from where it would normally be positioned to achieve a comparable fretting effect.

21 Claims, 7 Drawing Sheets

CAPO WITH ATTACHMENT MECHANISM AND FRETTING ACTION IN SEPARATE OFFSET PLANES

BACKGROUND

The subject matter disclosed herein relates to a capo for use on a stringed instrument, such as an electric guitar, acoustic guitar, bass guitar, ukulele, twelve-string guitar, mandolin, banjo, and so forth.

Various stringed musical instruments include a neck or other region over which the strings run and upon which a musician can effectively shorten the length of a string by pressing (i.e., fretting) the respective string against the underlying surface or against a ridge (i.e., a fret) running across the underlying surface. By effectively changing the length of the string that vibrates, a musician, in this manner, may achieve a desired note.

In some instances, an add-on device may be employed to facilitate such an operation. For example, a capo is a device placed around the neck of a stringed (typically fretted) instrument (such as a guitar) to shorten the playable length of the strings, thereby raising the pitch of all of the strings. Musicians commonly use a capo to raise the pitch of a fretted instrument so they can play in a different key using the same fingerings as playing open (i.e., without a capo). In effect, a capo uses a fret of an instrument to create a new nut at a higher note than the instrument's actual nut.

One issue with using a capo, however, is that, when positioned on the instrument neck, the capo must be placed as close as possible to the fret being employed (on the side of the fret away from the saddle) so as to provide enough downward pressure on the strings to get a good fretted tone without excessively bending the strings, causing the notes on all the strings to go up in pitch (go sharp). However, the closer the capo is to such fret, the more the capo may restrict the positioning or movement of the musician's hand on the instrument, and/or lead to uncomfortable rubbing or contact during play.

BRIEF DESCRIPTION

The present device and approach relate to the use of a capo that includes a fretting component (e.g., a blade) that has an edge that applies pressure to the strings in a plane offset from a plane defined by the attachment mechanism of the capo. Furthermore, such offset is substantial in comparison to the desirable small distance from the plane where the capo applies pressure to the strings to the plane of the fret being employed. Consequently, the present device and approach allow the benefit of the capo pressure being applied close to the fret being employed while allowing the attachment mechanism to be much further back, thus improving comfort and playability when using a capo. The capo may be used on a stringed instrument, such as a guitar. In one embodiment, the fretting component is removable and/or replaceable with respect to the attachment portion of the capo, allowing different fretting components to be used with the same attachment portion. In other embodiments, the attachment mechanism and fretting component are a single piece or are otherwise not separable.

In certain embodiments, the fretting component pivots with respect to a bar or other portion of the attachment mechanism. In other embodiments, the fretting component is fixed with respect to the attachment mechanism (i.e., does not pivot, rotate, or otherwise move freely with respect to the attachment mechanism). In both instances, the attachment mechanism causes the fretting edge of the fretting component to exert downward pressure on the strings in a plane perpendicular (cross-sectional) to the fingerboard so as to cause the fretting edge to fret the underlying strings. In both instances, the fretting edge applies downward pressure to the strings within such plane, which plane is offset from and parallel to (and thus does not intersect) the perpendicular (cross-sectional) plane defined by the centerline of the attachment mechanism. I.e., the fretting component has a fretting edge that is offset from the plane defined by the attachment mechanism and that applies pressure to the strings, when in a playable configuration, in a plane that is substantially perpendicular to the neck of the instrument.

In such embodiments, the fretting component allows the attachment portion of the capo to be offset from the fretting edge linearly along the neck of the instrument. Such a configuration allows increased access and comfort for the fretting hand when in use. In particular, with respect to a typical or conventional capo, the portion of the capo which frets the strings does so substantially within the same plane defined by the attachment mechanism of the capo. As a result, in order to achieve proper fretting from a musical perspective, the attachment mechanism is typically in the way of a player's hand when fretting. In contrast, in accordance with capo embodiments discussed herein, the attachment mechanism is offset from the portion of the capo used to fret the strings, and thus is much less likely to be in the way of a player's hand when fretting.

From a practical perspective, this may have certain benefits, including providing more room for the players hand when fretting. In particular, this arrangement has the desirable benefit of allowing a fretting edge of the capo to contact the strings immediately behind the desired fret on the nut-side of the neck while the attachment mechanism of the capo, which may be bulky, is linearly offset so from this fretting contact point. Or, simply put, the offset between the attachment mechanism and fretting edge allows placement of the fretting edge close to the fret while still providing space for the player's hand.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
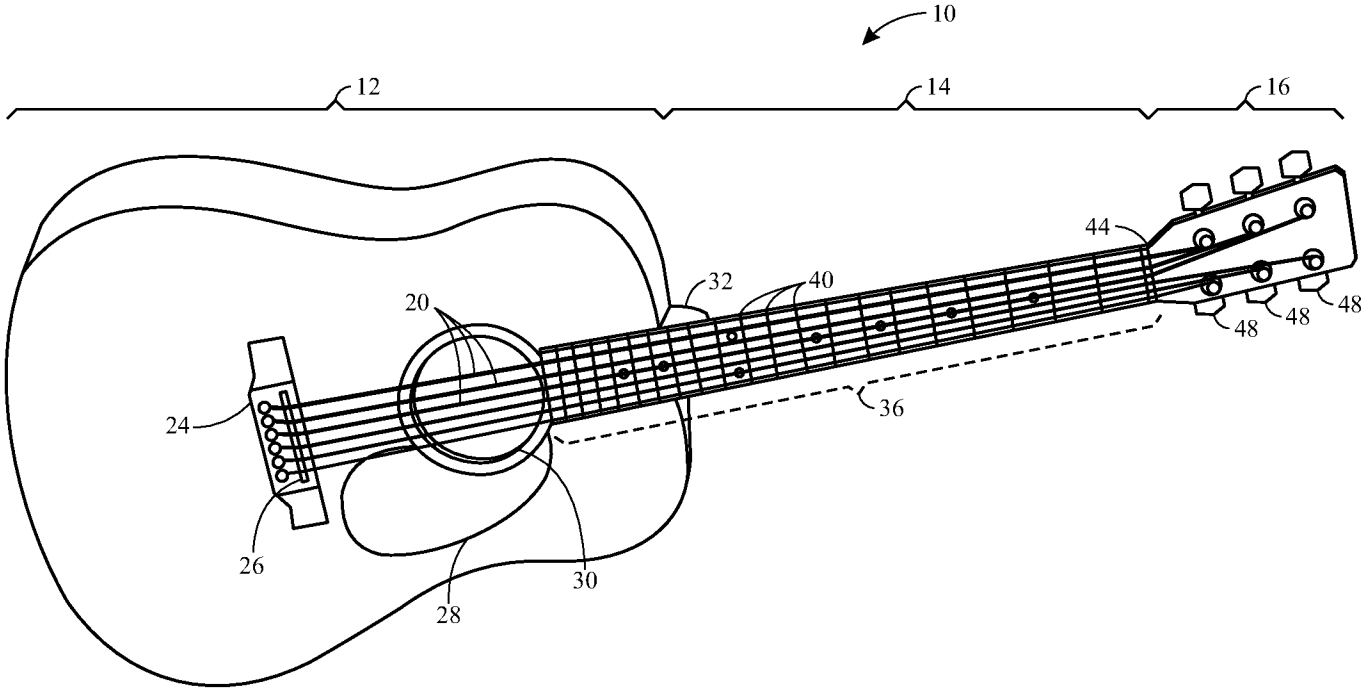
FIG. 1 depicts a stringed instrument, here a guitar, suitable for use with a capo, in accordance with aspects of the present discussion.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

A fretting component (referred to as a "blade" in certain implementations) of a capo for use with a stringed instrument is described. In certain embodiments the fretting component is distinct from the attachment mechanism of the capo and may, in one embodiment, pivot with respect to a portion (e.g., a crossbar) of the attachment mechanism. By way of example, the fretting component may pivot about a bar or other portion of the attachment mechanism lying along the centerline of the plane defined by the attachment mechanism. In such an implementation, a fretting edge of the fretting component, when in use, is substantially offset (relative to the distance from the fretting edge to the fret being employed) from the centerline of the plane of the attachment mechanism, and would apply pressure to the strings in a perpendicular (cross-sectional) plane that is similarly offset and is parallel to the plane of the attachment mechanism. The fretting component, when in use, overlies the instrument strings and pivots to allow a fretting edge of the fretting component to contact the strings. Depending on the embodiment, the fretting component and attachment mechanism may be separable or inseparable.

In other embodiments, the fretting component may not pivot or rotate (or otherwise move freely) with respect to the attachment mechanism but may instead be affixed to the attachment mechanism. In such an embodiment, the fretting component may be pressed downward (i.e., toward the strings) during play to perform a fretting operation. In such an implementation, the fretting edge of the fretting component, when in use, is still substantially offset (relative to the distance from the fretting edge to the fret being employed) from the centerline of the plane of the attachment mechanism and would apply pressure to the strings in a perpendicular (cross-sectional) plane that is similarly offset and is parallel to the plane of the attachment mechanism.

With the preceding in mind, examples of an embodiment of a capo and other additional context are described below to facilitate explanation and understanding of the contemplated concepts. Turning to FIG. 1, an example of a musical instrument, here an acoustic guitar 10, is depicted that is suitable for use with a capo. As will be appreciated, the guitar 10 is provided merely to illustrate one example of a musical instrument suitable for use with the present capo and other instruments (e.g., other types of guitars (such as electric guitars, bass guitars, twelve-string guitars), ukuleles, mandolins, banjos, and so forth) may also benefit from the use of the capo described herein. Thus, suitable instruments include, but are not limited to, a guitar as shown in FIG. 1.

With respect to FIG. 1, the guitar 10 may include various features or components which may be present on various regions of the guitar 10, such as the body 12, the neck 14, and the headstock 16. As depicted, the strings 20 of the guitar 10 run from the body 12, along the neck 14, and to the headstock 16. On the body 12, the strings 20 may be secured to a bridge region 24 that transfers the vibrations of the strings 20 to the soundboard 22. Within the bridge region 24 is a saddle 26 that supports and elevates the strings 20 and which provides one of the end points for the vibration of the strings 20. The body 12 may also include a pickguard 28 and soundhole 30.

A heel 32 may be present at the junction of the neck 14 and body 12. A fretboard (i.e., fingerboard) region 36 may run the length of the neck 14 and also to the adjoining region of the body 12. The fretboard 36 may be characterized by the presence of one or more frets 40 in the form of raised regions (e.g., metal strips or ridges) upon which one or more strings 20 may be pressed during a fretting operation. In addition, the fretboard 36 may include one or more inlays as visual elements.

At the end of the neck 14 opposite the body 12, the nut 44 transitions the neck 14 to the headstock 16. The nut 44 is a strip of material having grooves that align the strings 20 relative to the fretboard 36, and provides the other end point for the vibration of the strings 20. Beyond the nut 44, the strings 20 are secured to the headstock 16, where tuning pegs 48 may be used to adjust the tension of the respective strings 20.

Figure 2:
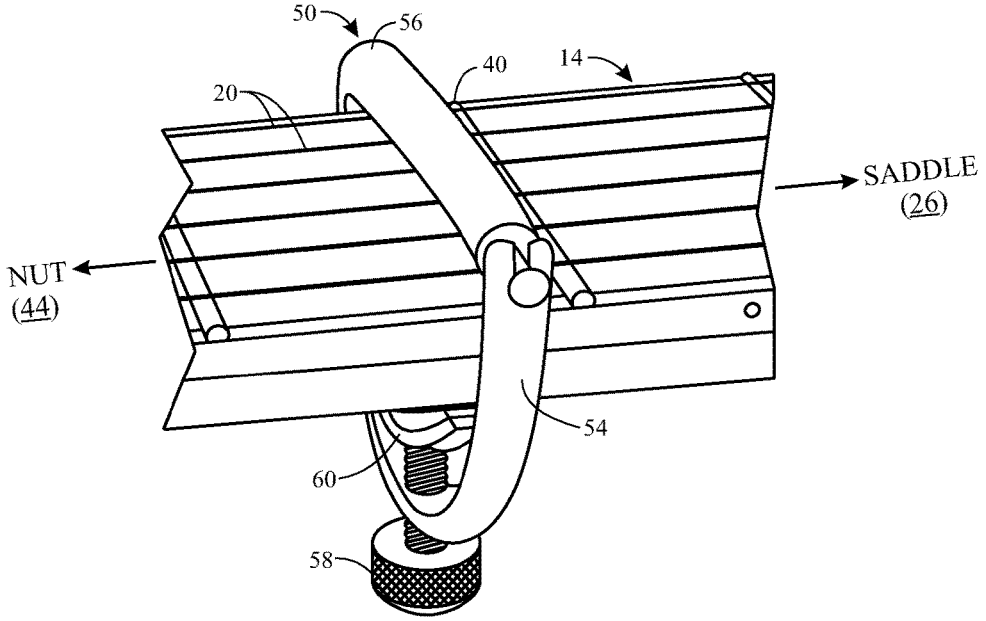
FIG. 2 depicts a perspective view of a conventional capo positioned around the neck of a stringed instrument.
Figure 3:
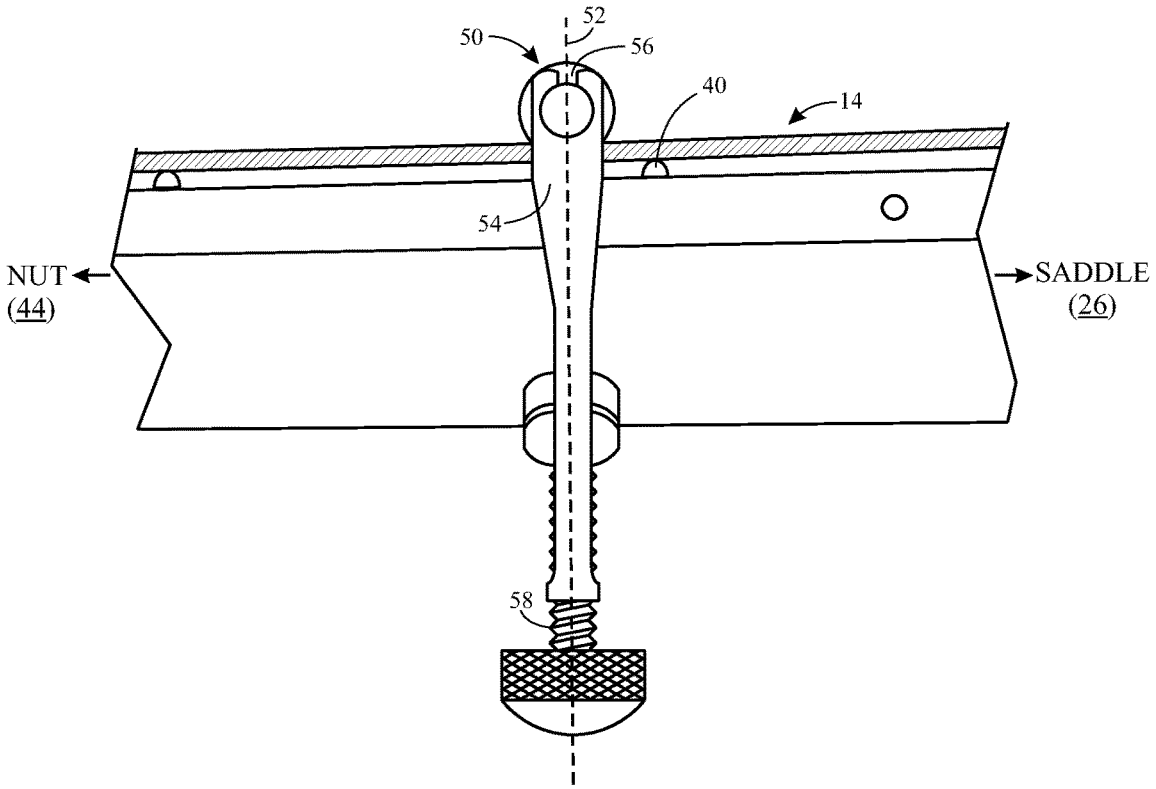
FIG. 3 depicts a side view of a conventional capo positioned around the neck of a stringed instrument.
Figure 4:
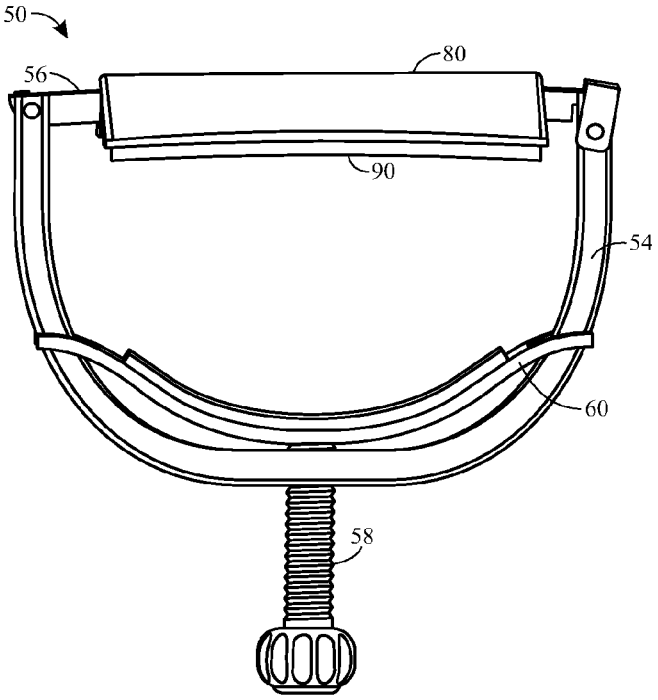
FIG. 4 depicts a first view of an embodiment of a capo having a fretting attachment, in accordance with aspects of the present discussion.

With the preceding in mind, FIG. 2 depicts a perspective view and FIG. 3 depicts a side view of a conventional capo 50 positioned about the neck 14 of a guitar 10 proximate to a fret 40. The depicted capo 50 is composed of a variety of pieces, such as a yoke region 54 that supports a bar 56, which in combination encircles the neck 14. In addition, the depicted capo include an attachment mechanism, e.g., a tensioning screw 58 which moves a yoke clamp 60 that may be tightened so as to secure the capo 50 to the neck 14 of the instrument. In the depicted example the capo 50, including the attachment mechanism components, define a centerline or plane 52 substantially perpendicular to the neck 14 of the instrument to which the capo 50 is attached. In this example, the centerline or plane 52 perpendicular to the neck is also the centerline or plane of the fretting action of a traditional capo.

Though a yoke-based attachment (i.e., a clamping mechanism) is shown by way of example in this and other figures, it should be appreciated that this is merely to provide a useful example and to facilitate the present discussion by providing a helpful attachment context. Other attachment mechanisms, such as clothespin-type or cam-based attachment mechanisms, may instead be employed to secure the capo 50 to the instrument and may also be used with a fretting component as described herein.

In conventional approaches involving a capo implementation as shown in FIGS. 2 and 3, when positioned as shown the capo 50 may be used to press the strings 20 downward toward the neck 14, thereby tensioning the strings 20 against the fret 40 to effectively shorten the portion of the strings 20 capable of vibrating when played. As may be noted in FIGS. 2 and 3, when the capo 50 is so positioned, it is close to the respective fret 40 so as to be able to effectively press the strings 20 against the proximate fret 40. However, when so positioned the capo 20 may limit or restrict movement or positioning of the musician's hand on the neck 14 and near the fret 40 because the attachment mechanism is also close to the fret 40 being employed.

Figure 5:
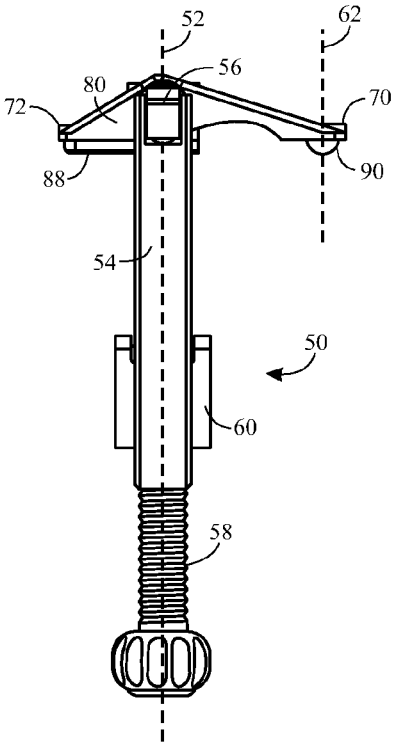
FIG. 5 depicts a second view of an embodiment of a capo having a fretting attachment, in accordance with aspects of the present discussion.

In contrast, and as shown in embodiments described below, the offset between the attachment mechanism and fretting edge of the present capo designs allows placement of the fretting edge close to the fret while allowing the attachment mechanism to be much further back toward the nut 44, providing space for the player's hand. For example, in certain implementations, in FIG. 5 the bar 56 may be used as pivot for a separate fretting component 80 having a fretting edge applying pressure to the strings in a plane 62 that is offset from the plane 52 defined by the attachment mechanism, thus addressing certain of these hand position concerns.

With this in mind, in FIGS. 4-9, an embodiment of a fretting component 80 is shown that pivots about the bar 56 of a capo 50. In the depicted example, the fretting component 80 is in the form of wedge or blade that pivots about the bar 56, which runs through a through-hole 82 of the fretting component 80. As depicted, when in a playable position the pivot point is within the plane 52 of the attachment mechanism, while the fretting edge 70 applies pressure to the strings in a plane that is not within the attachment mechanism plane 52 during play. Instead, the fretting edge 70 applies pressure to the strings in a parallel fretting plane 62 offset from the attachment mechanism plane 52. Similarly, in non-pivoting implementations (i.e., fixed implementations) the fretting edge 70 may apply pressure to the strings entirely within the fretting plane 62, offset from and parallel to the attachment mechanism plane 52.

Figure 6:
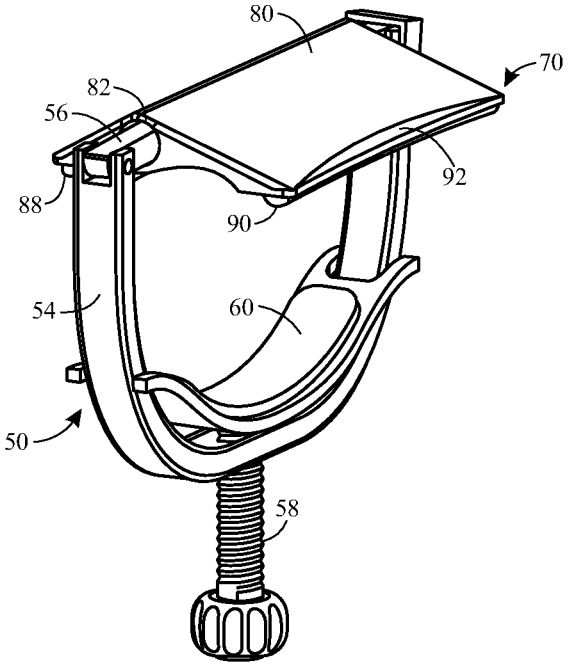
FIG. 6 depicts a perspective view of an embodiment of a capo having a fretting attachment in a playable configuration, in accordance with aspects of the present discussion.
Figure 7:
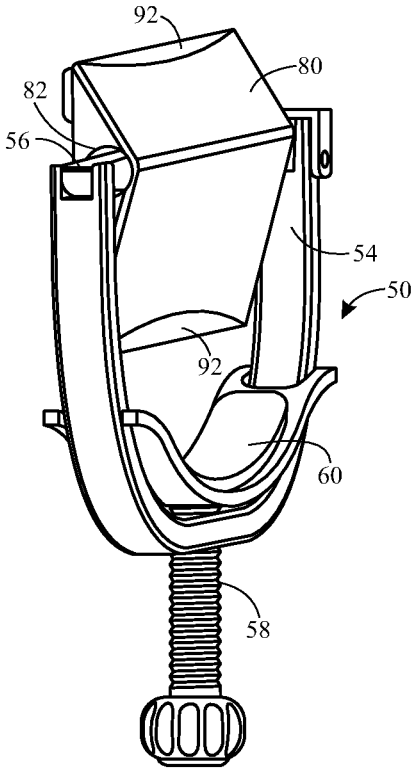
FIG. 7 depicts a perspective view of an embodiment of a capo having a fretting attachment in a storage configuration, in accordance with aspects of the present discussion.
Figure 8:
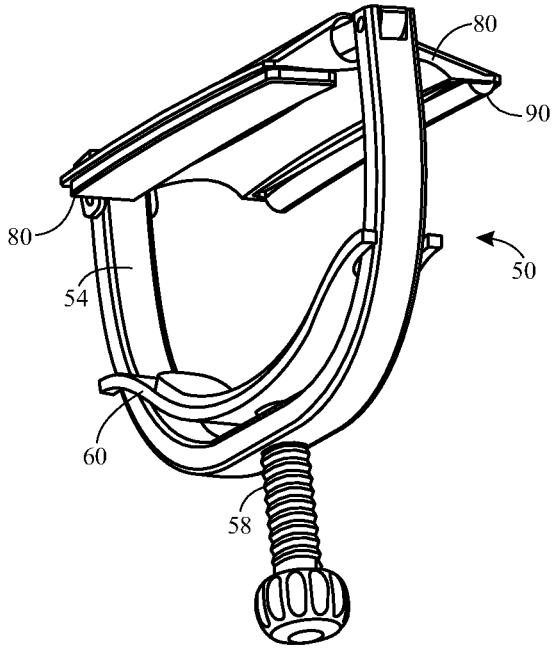
FIG. 8 depicts another perspective view of an embodiment of a capo having a fretting attachment in a playable configuration, in accordance with aspects of the present discussion.
Figure 9:
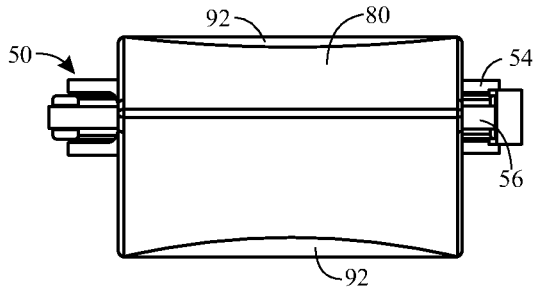
FIG. 9 depicts a top-down view of a capo having a fretting attachment in a playable configuration, in accordance with aspects of the present discussion.

In embodiments where the fretting component 80 is free to pivot, it may also be noted that the pivot motion also facilitates a storage configuration so that the fretting component 80 can be pivoted parallel to the remainder of the body of the capo 50 and stored when not in use in a slimmer form, as shown by way of comparison in FIGS. 6 and 7. As noted above, in embodiments in which the fretting component 80 is separable from the remainder of the capo 50, different fretting components 80 (such as fretting components having different sizes, shapes, profiles, compositions, or designs) may be substituted on the capo 50, allowing a user to select the appropriate fretting component 80 for a given instrument and/or performance.

In pivoting implementations, as depicted, the fretting component 80 pivots at a single point (i.e., through-hole 82 and bar 56). A fretting edge 70 is on a portion of the fretting component 80 extending toward the saddle 26 while a counter-force edge 72 is on a portion of the fretting component 80 extending toward the nut 44. When fretting, the fretting edge 70 of the fretting component 80 exerts force downward so as to press the strings 20 downward toward the neck 14 of the instrument and tension the strings against a fret 40 proximate to this contact point (i.e., beneath the fretting edge 70). In one embodiment, the counter-force edge 72 opposite the fretting edge 70 is used to counteract the upward force exerted on the fretting component 80 nearer the saddle 26 when in use. In certain embodiments, the portion of the fretting component 80 extending towards the saddle 26 may be streamlined with a relatively low profile so as to increase access and comfort for the fretting hand of the musician.

In terms of construction, the width of the fretting component 70 will typically be a function of the width of the fingerboard 36 over which it will be positioned, which will vary based on the instrument and the placement of the capo 50. By way of example, for a typical guitar implementation, the fretting component 70 may be between about 1.75" and 2.25" wide (i.e., approximately 4.45 cm to 5.72 cm wide) in the dimension corresponding to the width of the neck 14 of the guitar.

The fretting component 80 may be fabricated from a variety of materials including, but not limited to: stainless steel, brass, aluminum, plastic, and so forth and may be fabricated using milling techniques (e.g., CNC milling), additive manufacturing techniques (e.g., 3D printing), or other suitable fabrication technologies.

In the depicted examples, the instrument facing surfaces of the fretting component 80 include two bumpers: a fretting bumper 90 on the fretting edge 70 and counter-force bumper (i.e., back rubber) 88 on the counter-force edge 72. The counter-force bumper 88 may be extended and relatively flat so as to allow more contact with the strings 20. In certain embodiments the fretting bumper 90 is rounded, like a portion of tubing, so as to better focus the fretting pressure applied by the user, though in other embodiments the fretting bumper 90 may also be flat or otherwise less rounded. One or both bumpers 88, 90 may be constructed from a malleable or rubberlike material suitable for contacting the strings 20 when in use. The fretting bumper 90 and counter-force bumper 88 may or may not be made using the same material and/or the same hardness or softness of material. In practice, the fretting bumper 90 makes contact with the strings 20 when fretting so as to tension the strings 20 against a fret 40. The counter-force bumper 88 helps absorb the forces generated when applying downward pressure to the fretting edge 70 when fretting.

In certain embodiments, the fretting component 80 also includes one or more curved shelf regions 92. The curved shelves 92, when present, allow the edges (e.g., fretting edge 70 and/or counter-force edge 72) of the fretting component 80 to be substantially constant thickness, which may be desirable from the standpoint of musician interaction or contact with the fretting component 80.

Figure 10:
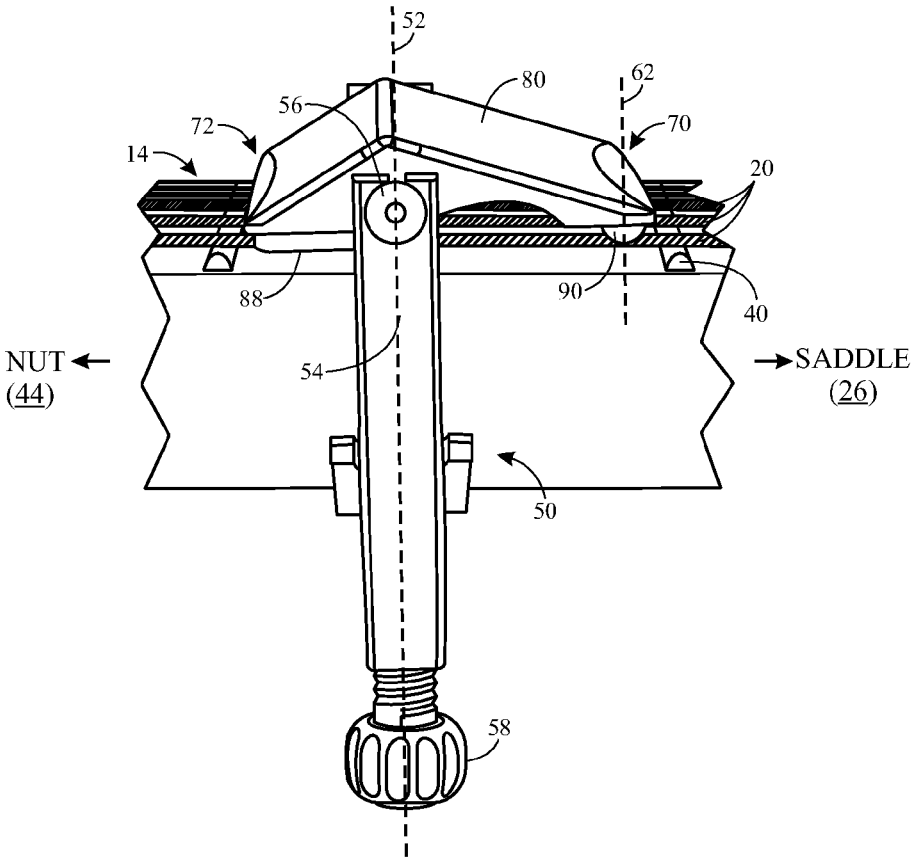
FIG. 10 depicts a side view of a capo positioned around the neck of a stringed instrument, in accordance with aspects of the present discussion.

With these various structural and composition examples in mind, FIG. 10 shows an example of the use of the fretting component 80 when part of a capo 50. The example in FIG. 10 is shown in the same context as the capo example shown in FIGS. 2 and 3, but with the fretting contact point (i.e., fretting edge 70 and fretting bumper 90 under the fretting edge 70) lying within fretting plane 62, which is substantially offset (relative to the distance from the fretting edge to the fret being employed) with respect to the attachment plane 52 defined by the attachment mechanism. Similarly, the counter-force edge 72 and counter-force bumper 88 are also offset, though in the opposite direction, from the attachment plane 52.

By way of example, the fretting edge 70 and fretting bumper 90, when in use, may be positioned (denoted by fretting plane 62) immediately adjacent (or otherwise close) to the fret 40 being employed. However, the placement of the capo attachment mechanism (denoted by attachment plane 52) is linearly offset toward the nut-end of the instrument. By offsetting the attachment of the fretting component 80 behind the point of compression of the instrument strings 20 (e.g., guitar strings) when playing, the musician is less restricted when playing in close proximity to the installed capo 50.

EXAMPLES

The preceding examples depict a yoke-based attachment mechanism for a capo 50 that encircle the neck 14 of the instrument when deployed. As will be appreciated from the preceding discussion however, other types of attachment mechanisms for a capo 50 may be employed while still falling within the scope of the presently disclosed concept. In particular, capo attachment mechanisms that lie within a plane 52 that does not encompass the fretting edge 70 and fretting bumper 90 of the capo 50 when in play are presently contemplated and encompassed by the present disclosure. To expand upon this point, additional, alternative examples of contemplated capo attachment mechanisms are provided herein. As will be appreciated, possible suitable capo attachment mechanisms include, but are not limited to, those described herein.

Figure 11:
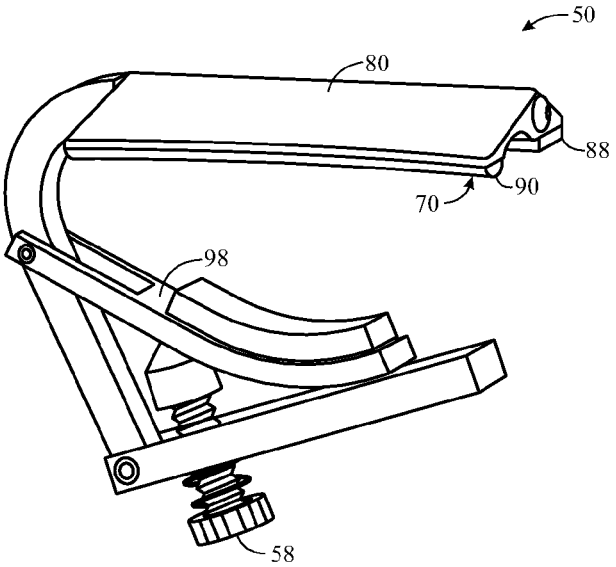
FIG. 11 depicts an alternative implementation of an attachment mechanism for use with a capo, in accordance with aspects of the present discussion.

With this in mind, and turning to FIG. 11, an open attachment mechanism is depicted which includes using a tensioning screw 58 (as in previous depicted example) but which remains open in one direction even when applied to the neck of an instrument. In this example, the tensioning screw 58 is used to adjust and tighten a movable arm 98 against the neck 14 of the instrument and to thereby hold the capo 50 tightly against the instrument.

As noted with respect to previous examples, in a playable position, the fretting edge 70 and fretting bumper 90 are offset from a plane defined by the attachment mechanism (i.e., tensioning screw 58 and arm 98 and any other portions of such capo 50 other than the fretting component 80). Thus, when in use, the fretting edge 70 and fretting bumper 90 may apply pressure to the strings within a fretting plane that is offset from, and generally parallel to or non-intersecting with the attachment plane defined by the attachment mechanism.

Figure 12:
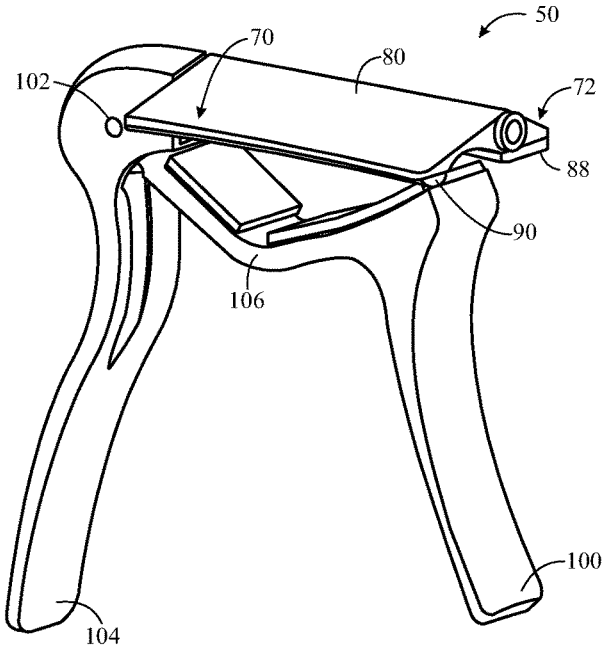
FIG. 12 depicts a second alternative implementation of an attachment mechanism for use with a capo, in accordance with aspects of the present discussion.
Figure 13:
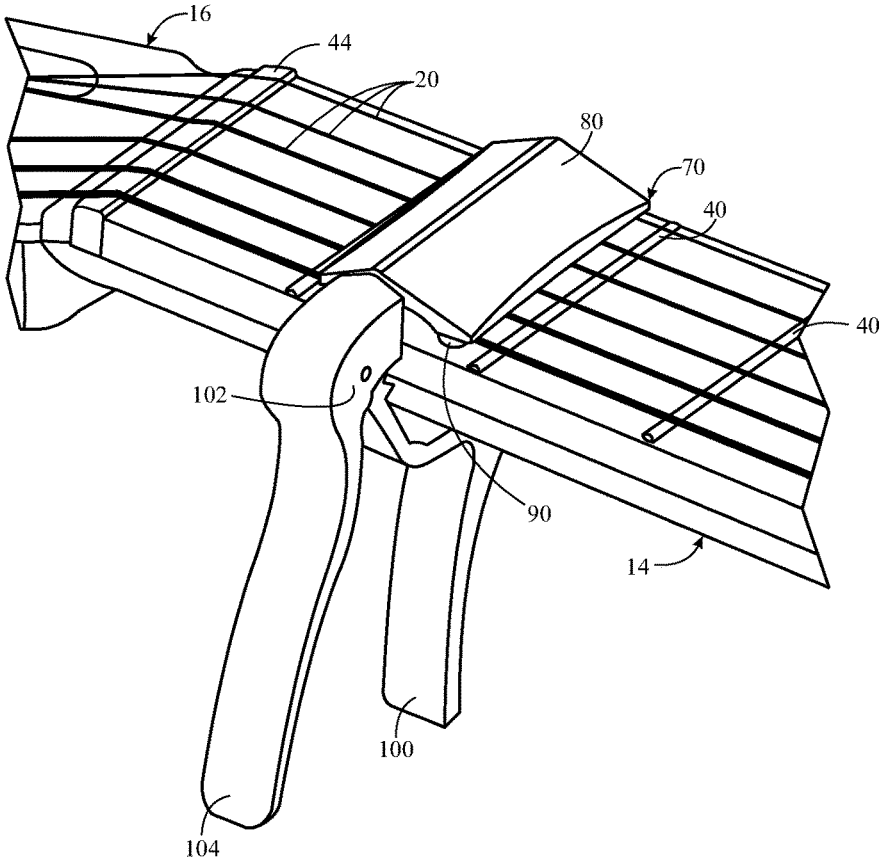
FIG. 13 depicts the capo of FIG. 12 positioned on a guitar neck, in accordance with aspects of the present discussion.

In another example, and turning to FIGS. 12 and 13, the attachment mechanism may be held securely to the instrument neck 14 using mechanisms other than a tensioning screw 58, such an internal or external spring or other intrinsically biasing member. In this example, the capo attachment mechanism includes two handles 100, 104 that are biased apart from one another, such as by an internal coil spring or other suitable biasing member. The handles 100 and 104 can, however, be squeezed together by application of a force that overcomes the bias supplied by the internal biasing member and, when so squeezed, may pivot with respect to pivot point 102, moving the handles 100, 104 closer together the arm bridge 106 away from the fretting component. When so opened, the capo 50 may placed on the neck 14 of an instrument. When so placed, pressure may be released, allowing the bias force provided by the biasing member (e.g., a coil spring) to secure the capo 50 to the neck 14 of the instrument, as shown in FIG. 13, and cause the fretting edge to apply pressure to the strings.

As noted with respect to previous examples, in a playable position (as shown in FIG. 13), the fretting edge 70 and fretting bumper 90 are offset set from the plane defined by the attachment mechanism (i.e., handles 100 and 104 and any other portions of such capo 50 other than the fretting component 80). Thus, when in use, the fretting edge 70 and fretting bumper 90 may apply pressure to the strings within a fretting plane that is offset from, and generally parallel to and non-intersecting with the attachment plane defined by the attachment mechanism.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A capo, comprising:

an attachment mechanism configured to secure the capo to a neck of a stringed instrument, wherein the attachment mechanism defines an attachment plane of the capo perpendicular to the fingerboard; and a fretting component attached to the attachment mechanism, the fretting component comprising:

a fretting edge positioned offset from the attachment plane of the capo when in a playable configuration, wherein the fretting edge applies pressure to the strings within a fretting plane that is offset from and substantially parallel to the attachment plane when in the playable configuration; and a counter-edge positioned offset from attachment plane of the capo opposite the fretting edge when in the playable configuration, wherein a first distance between the fretting edge and the counter-edge is less than a second distance between a nut of the stringed instrument and a first fret of the stringed instrument, wherein when positioned in the playable configuration with the fretting edge behind the first fret, a playable sound for the stringed instrument is produced, wherein the fretting component further comprises a pivot hole about which the fretting component pivots about a crossbar of the attachment mechanism.

2. The capo of claim 1, wherein the fretting edge, when the fretting component pivots and moves within a limited arc, applies pressure to the strings within the fretting plane.

3. The capo of claim 1, wherein the fretting component is fixedly attached to the attachment mechanism such that the fretting edge, when in use, applies pressure to the strings substantially within the fretting plane.

4. The capo of claim 1, wherein the fretting edge comprises a fretting bumper configured to contact one or more strings when in use.

5. The capo of claim 4, wherein the fretting bumper comprises a rubber-like material.

6. The capo of claim 1, further comprising a counter-force bumper on the counter-force edge.

7. The capo of claim 1, wherein the fretting component comprises one or more of a metal body or a plastic body.

8. The capo of claim 1, wherein the attachment mechanism comprises a tensioning member or biasing member to secure the capo to the neck of the stringed instrument.

9. The capo of claim 1, wherein the fretting component is configured to be detachable from the capo.

10. The capo of claim 1, wherein the playable configuration comprises the stringed instrument being configured for playing music.

11. A fretting component, comprising:

a fretting component body;

a mounting interface of the fretting component body configured to interface with an instrument attachment mechanism;

a fretting edge of the fretting component body on one side of the mounting interface, wherein the fretting edge is offset from the mounting interface and is movable between a string-contacting position and a non-contact position when in use;

a fretting bumper on a string-facing surface of the fretting edge;

a counter-force edge of the fretting component body opposite the fretting edge with respect to the mounting interface; and a counter-force bumper on the string-facing surface of the counter-force edge, wherein a first distance between the fretting edge and the counter-force edge is less than a second distance between a nut of a stringed instrument and a first fret of the stringed instrument, wherein when positioned in a playable configuration with the fretting edge behind the first fret, a playable sound for the stringed instrument is produced, wherein the mounting interface comprises a through-hole configured to fit around and pivot about a crossbar of a capo assembly.

12. The fretting component of claim 11, wherein the fretting component body comprises one or more of stainless steel, brass, aluminum, or plastic.

13. The fretting component of claim 11, wherein the fretting bumper is rounded.

14. The fretting component of claim 11, wherein the counter-force bumper is flat.

15. The fretting component of claim 11, wherein one or both of the fretting edge and counter-force edge include shelf regions of substantially constant thickness.

16. The fretting component of claim 11, wherein one or both of the fretting edge and counter-force edge comprise a rubber-like material.

17. The fretting component of claim 11, wherein the instrument attachment mechanism comprises a tensioning member or biasing member to secure the fretting component to the neck of the stringed instrument.

18. The fretting component of claim 11, wherein the fretting component is detachable from the instrument attachment mechanism via the mounting interface.

19. The fretting component of claim 11, wherein the fretting component is not configured to detach from the instrument attachment.

20. A capo, comprising:

an attachment mechanism configured to secure the capo to a neck of a stringed instrument, wherein the attachment mechanism defines an attachment plane of the capo perpendicular to the fingerboard; and a fretting component attached to the attachment mechanism, the fretting component comprising:

a fretting edge positioned offset from the attachment plane of the capo when in a first and a second playable configurations, wherein the fretting edge applies pressure to the strings within a fretting plane that is offset from and substantially parallel to the attachment plane when in the first and the second playable configurations; and a counter-edge positioned offset from attachment plane of the capo opposite the fretting edge when in the first and the second playable configurations, wherein the fretting component further comprises a pivot hole positioned closer to the counter-edge than to the fretting edge about which the fretting component pivots about a crossbar of the attachment mechanism, and wherein the fretting component pivots about the crossbar and is secured to the neck of the stringed instrument at a first angle relative to the neck when in the first playable configuration and pivots about the crossbar and is secured to the neck of the stringed instrument at a second angle relative to the neck of the when in the second playable configuration.

21. A capo, comprising:

an attachment mechanism configured to secure the capo to a neck of a stringed instrument, wherein the attachment mechanism defines an attachment plane of the capo perpendicular to the fingerboard; and a fretting component attached to the attachment mechanism, the fretting component comprising:

a fretting edge positioned offset from the attachment plane of the capo when in a playable configuration, wherein the fretting edge applies pressure to the strings within a fretting plane that is offset from and substantially parallel to the attachment plane when in the playable configuration; and a counter-edge positioned offset from attachment plane of the capo opposite the fretting edge when in the playable configuration, wherein the fretting edge is secured directly behind a playable fret of the stringed instrument when in the playable configuration, wherein the fretting component pivots about the crossbar and is positioned for storage at a third angle in a storage configuration, wherein in the third angle the fretting component is rotated to lie approximately parallel to the attachment plane.

* * * * *